US006773091B2

(12) United States Patent
Miyamoto et al.

(10) Patent No.: US 6,773,091 B2
(45) Date of Patent: Aug. 10, 2004

(54) LIQUID DISCHARGE DEVICE AND METHOD OF MANUFACTURING THE SAME

(75) Inventors: Takaaki Miyamoto, Kanagawa (JP); Shogo Ono, Kanagawa (JP); Osamu Tateishi, Nagasaki (JP); Toshimitsu Sato, Nagasaki (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/307,681

(22) Filed: Dec. 2, 2002

(65) Prior Publication Data

US 2003/0151646 A1 Aug. 14, 2003

(30) Foreign Application Priority Data

Dec. 3, 2001 (JP) ..... 2001-368020

(51) Int. Cl.[7] ..... B41J 2/05
(52) U.S. Cl. ..... 347/64
(58) Field of Search ..... 347/56–59, 63–65

(56) References Cited

U.S. PATENT DOCUMENTS 6,474,769 B1 * 11/2002 Imanaka et al. ..... 347/65

* cited by examiner

*Primary Examiner*—Stephen D. Meier
*Assistant Examiner*—An H. Do
(74) *Attorney, Agent, or Firm*—Robert J. Depke; Holland & Knight LLP

(57) ABSTRACT

The present invention relates to a liquid discharge device, and a method of manufacturing the liquid discharge device. Particularly, the present invention relates to a liquid discharge device in a system in which droplets are ejected by heating with a heating element, and which is capable of effectively avoiding deterioration in reliability due to damage to a protecting layer. In the present invention, heat treatment is performed for stabilizing the connection between the heating element and a wiring pattern, and then an anti-cavitation layer is formed.

2 Claims, 8 Drawing Sheets

LIQUID DISCHARGE DEVICE AND METHOD OF MANUFACTURING THE SAME

This application claims priority to Japanese Patent Application Number JP2001-368020 filed Dec. 3, 2001, which is incorporated herein by reference.

BACKGROUND OF THE INVENTION

1. Field of the Invention

The present invention relates to a liquid discharge device, and a method of manufacturing the same. Particularly, the present invention relates to a liquid discharge device in a system in which droplets are ejected by heating with a heating element. In the present invention, in order to effectively avoid deterioration in reliability due to damage to a protective layer, an anti-cavitation layer is formed after heat treatment for stabilizing connections.

2. Description of the Related Art

In the field of image processing, needs for coloring of hard copies have recently increased. In order to meet the needs, color hard copy systems such as a sublimation thermal transfer system, a melting thermal transfer system, a liquid discharge system (ink jet system), an electrophotographic system, a thermally processed silver system, etc. have been conventionally proposed.

Of these systems, in the ink jet system as the liquid discharge system, droplets of a liquid (ink) are ejected from nozzles provided on a recording head, and adhered to a recording object to form dots, thereby outputting an image of high quality by a simple structure. This ink jet system is classified into an electrostatic system, a continuous vibration generating system (piezo system), a thermal system, etc. according to ink ejection systems.

Of these systems, the thermal system is a system in which bubbles are produced by locally heating an ink, and the ink is ejected from the nozzles by the bubbles, and flies to the recording object so that a color image can be printed by a simple structure.

Namely, this thermal-system liquid discharge device comprises a semiconductor substrate on which heating elements for heating an ink, driving circuits comprising logic integrated circuits for driving the heating elements, etc. are mounted. Therefore, the heating elements are arranged with a high density so that they can be securely driven.

Namely, in order to obtain a high-quality print result of the thermal-system liquid discharge device, the heating elements must be arranged with a high density. Specifically, for example, in order to obtain a print result corresponding to 600 (DPI), the heating elements must be arranged with intervals of 42.333 $\mu$m. It is thus very difficult to respectively dispose driving elements for the heating elements arranged with such a high density. Therefore, in the liquid discharge device, switching transistors are formed on the semiconductor substrate, and the heating elements respectively corresponding to the switching elements are connected by an integrated circuit technique so that the switching transistors can be respectively driven by driving circuits formed on the semiconductor substrate to simply and securely drive the heating elements.

In the thermal-system liquid discharge device, when bubbles are produced in an ink by heating with the heating elements to eject the ink from nozzles by the bubbles, the bubbles disappear. Therefore, bubbling and debubbling are repeated to cause a mechanical shock due to cavitation. Also, a temperature rise by heating with the heating elements and a temperature drop are repeated within a short time (several seconds) to cause a great stress due to temperature.

Therefore, in the liquid discharge device, each of the heating elements is formed by using tantalum, tantalum nitride, tantalum aluminum, or the like, and a protecting layer composed of silicon nitride is formed on the heating elements, for improving heat resistance and insulation by the protecting layer, and for preventing direct contact between the heating elements and an ink. Furthermore, an anti-cavitation layer is formed on the protecting layer, for relieving a mechanical shock due to cavitation. The anti-cavitation layer has excellent acid resistance, and a passive film is easily formed on the surface of the anti-cavitation film. Also, the anti-cavitation film is made of tantalum with excellent heat resistance.

FIG. 7 is a sectional view showing the configuration of the vicinity of a heating element in this type of liquid discharge device of prior art. In the liquid discharge device 1, an insulating layer ($SiO_2$), etc. are formed on a semiconductor substrate 2 on which semiconductor elements are formed, and then a heating element 3 comprising a tantalum film is formed. Furthermore, a protecting layer 4 composed of silicon nitride ($Si_3N_4$) is laminated, and a wiring pattern (Al wiring) 5 is formed for connecting the heating element 3 to a semiconductor formed on the semiconductor substrate 2. Furthermore, a protecting layer 6 composed of silicon nitride ($Si_3N_4$) is laminated, and an anti-cavitation layer 7 composed of tantalum is formed on the protecting layer 6.

The liquid discharge device 1 is further heat-treated (sintered) at 400° C. for 60 minutes in an atmosphere of nitrogen gas ($N_2$) containing 4% of hydrogen gas ($H_2$) to stabilize the connections between the heating element and the wiring pattern and between wiring patterns, and compensating for silicon defects with the added hydrogen. Instead of the heat treatment in such an atmosphere, a heat treatment method in a hydrogen atmosphere is also proposed (Japanese Unexamined Patent Application Publication Nos. 7-76080 and 9-70973). Japanese Patent No. 2971473 discloses a method of heat-treating a protecting layer composed of silicon oxide formed by a bias sputtering process to decrease a residual stress in the protecting layer.

In the liquid discharge device 1, an ink chamber, an ink flow path, and a nozzle are then formed by disposing predetermined members. In the liquid discharge device 1, an ink is introduced into the ink chamber through the ink flow path, which are formed as described above, and the semiconductor element is driven to generate heat from the heating element, to locally heat the ink in the ink chamber. In the liquid discharge device 1, bubbles are produced in the ink chamber due to the heating to increase the pressure in the ink chamber, so that the ink is ejected from the nozzle, and flies to the recording object.

The protecting layer 6 has relatively low heat conductivity, and thus the thickness of the protecting layer 6 is decreased to improve heat conduction to the ink chamber, thereby effectively ejecting ink droplets. However, when the thickness of the protecting layer 6 is decreased, pinholes occur, and step coverage in a step portion at the interface between the protecting layer 6 and the wiring pattern 5 deteriorates to cause difficulties in completely isolating the heating element 3 from the ink. As a result, the wiring pattern 5 and the heating element 3 are corroded by the ink to deteriorate reliability, and the lifetime of the heating element 3 is shortened.

It is thus thought that when the protecting layer 6 is formed to a thickness of 300 nm, the occurrence of pinholes can be securely prevented, and sufficient step coverage can be secured in the step portion at the interface between the wiring pattern 5 and the protecting layer 6, thereby securing sufficient reliability.

According to experimental results, with the protecting layer 6 having a thickness of 300 nm, the occurrence of pinholes can be securely prevented, and sufficient step coverage can be secured. However, a crack B was observed in the protecting layer 6, as shown by arrow A in an enlarged partial view of FIG. 7. Like the pinholes, such a crack B allows the ink to enter the heating element 3, thereby significantly deteriorating the reliability of the printer head 1.

As a prior method for preventing the occurrence of the crack, a method of tapering the end surface of the wiring pattern 5 by wet etching during the formation of the wiring pattern 5 using an aluminum wiring material, as shown in FIGS. 8A and 8B, is proposed in, for example, Hewllet-Packard Journal, May, 1985, pp. 27–32. Namely, by tapering the end surface of the wiring pattern 5, the occurrence of a step in the protecting layer 6 formed thereon can be decreased, thereby preventing the concentration of stress and preventing the occurrence of a crack.

However, in a today's wiring pattern, a wiring pattern material comprises aluminum containing silicon, copper, or the like added for improving the properties and lifetime of the wiring pattern, and thus tapering of the end surface of the wiring pattern by wet etching has a problem in which silicon, copper, or the like added to the pattern material remains unetched to leave the residue of silicon, copper, or the like as dust in the etched portion.

SUMMARY OF THE INVENTION

The present invention has been achieved in consideration of the above problem, and it is an object of the present invention to provide a liquid discharge device capable of effectively avoiding deterioration in reliability due to damage to a protecting layer, and a method of manufacturing the same.

In order to achieve the object, in a first aspect of the present invention, a liquid discharge device comprises a protecting layer formed on a heating element, for protecting the heating element from a liquid, and an anti-cavitation layer formed for protecting the heating element from cavitation, wherein after the protecting layer is formed, at least the connections between the heating element and a wiring pattern and between the wiring pattern and a semiconductor element are stabilized by heat treatment, and then the anti-cavitation layer is formed.

In a second aspect of the present invention, a method of manufacturing a liquid discharge device comprises forming a protecting layer on a heating element to protect the heating element from a liquid, performing heat treatment for stabilizing at least the connections between the heating element and a wiring pattern and between the wiring pattern and a semiconductor element, and then forming an anti-cavitation layer for protecting the heating element from cavitation.

The anti-cavitation layer is required to protect the heating element by relieving cavitation, and thus a material having high stress, such as tantalum (Ta), or the like is used for the anti-cavitation layer. The compressive stress of a tantalum film is 1.0 to $2.0\times10^{10}$ (dyne/cm$^2$) . However, tantalum has a linear expansion coefficient of 6.5 (ppm/degree), aluminum generally applied to wiring patterns has a linear expansion coefficient of 23.6 (ppm/degree), and a protecting layer of $Si_3N_4$ formed between both materials has a linear expansion coefficient of 2.5 (ppm/degree). It is known that as in a conventional method, heat treatment after the formation of the anti-cavitation layer causes large thermal stress between these layers due to the differences between the linear expansion coefficients, and thus produces a crack in the protecting layer due to the thermal stress. However, in the liquid discharge device of the present invention, after the protecting layer is formed for protecting the heating element from a liquid, heat treatment is performed for stabilizing at least the connections between the heating element and the wiring pattern and between the wiring pattern and the semiconductor element, and then the anti-cavitation layer is formed for protecting the heating element from cavitation. Therefore, the concentration of thermal stress in the protecting layer during the heat treatment can be decreased, thereby effectively avoiding deterioration in reliability due to damage to the protecting layer.

Also, the method of manufacturing the liquid discharge device of the present invention can effectively avoid deterioration in reliability due to damage to the protecting layer.

DESCRIPTION OF THE PREFERRED EMBODIMENTS

Figure 1:
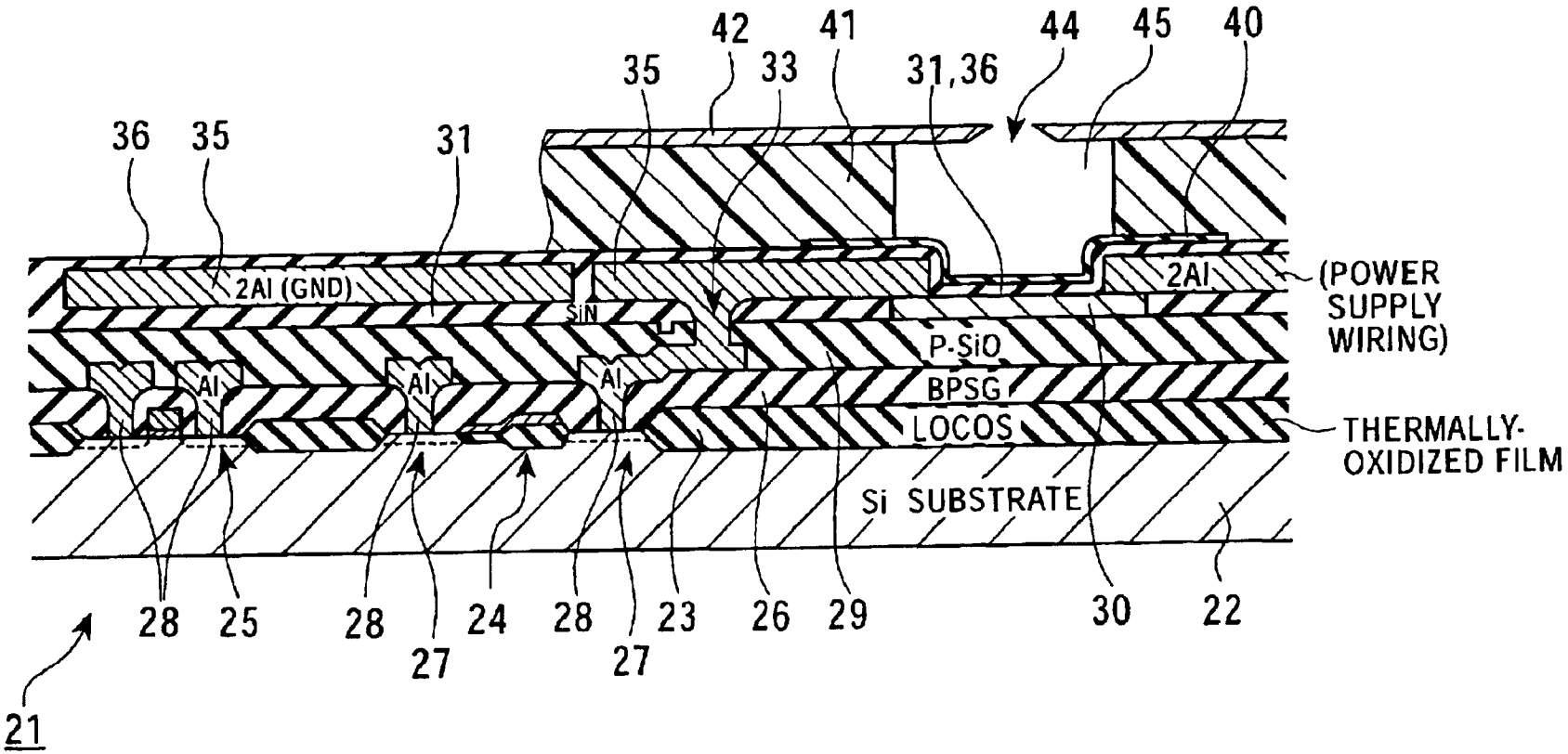
FIG. 1 is a sectional view showing a liquid discharge device according to a first embodiment of the present invention.

An embodiment of the present invention will be described in detail below with reference to the drawings.

(1) Construction of Embodiment

FIGS. 1 to 6 are sectional views illustrating a process for manufacturing a liquid discharge device 21 according to an embodiment of the present invention. This manufacturing process comprises washing a P-type silicon substrate 22, and then depositing a silicon nitride film (FIG. 2A). Then, the silicon substrate 22 is treated by lithography and reactive ion etching to remove the silicon nitride film ($SiN_4$) from regions other than predetermined regions where transistors are to be formed. Therefore, the silicon nitride film is formed in the regions of the silicon substrate 22, in which the transistors are to be formed.

In the manufacturing process, then a thermally-oxidized silicon film is formed, by thermal oxidation, in the regions from which the silicon nitride film is removed, to form element isolation regions (LOCOS) 23 having a predetermined thickness, for isolating the transistors by the thermally-oxidized film. Then, the silicon substrate 22 is washed, and a gate having the structure of tungsten silicide/ polysilicon/thermally-oxidized film is formed in each of the transistor formation regions. Furthermore, the silicon substrate 22 is treated by ion implantation for forming source and drain regions, and heat treatment to form MOS-type switching transistors 24 and 25, etc. The switching transistor 24 is a MOS-type driver transistor for driving a heating element, and has a withstand voltage of about 25 V. The transistor 25 is a transistor which constitutes an integrated circuit for controlling the driver transistor, and is operated with a voltage of 5 V. In this embodiment, a low-concentration diffusion layer is formed between the gate and drain so that an electric field of accelerated electrons is relieved in this diffusion layer, thereby securing the withstand voltage of the switching transistor 24.

After the transistors 24 and 25, which are semiconductor elements, are formed on the semiconductor substrate 22 as described above, a BPSG (Borophosphosilicate Glass) film 26 is formed by a CVD (Chemical Vapor Deposition) method. Then, contact holes 27 are formed above the silicon semiconductor diffusion layer (source and drain) by active ion etching with $C_4F_8/CO/O_2/Ar$ gases.

Furthermore, the semiconductor substrate 22 is washed with hydrofluoric acid, and a titanium layer having a thickness of 20 nm, a titanium nitride barrier metal layer having a thickness of 50 nm, and an aluminum layer containing 1 at % of silicon or 0.5 at % of copper and having a thickness of 400 to 600 nm are successively deposited by sputtering. Then, these deposited wiring pattern material layers are selectively removed by photolithography and dry etching to form a first wiring pattern 28. The first wiring pattern 28 is formed for connecting the MOS-type transistors 25 constituting the driving circuit to form a logic integrated circuit.

Then, a silicon oxide film 29 is deposited as an interlayer insulating film by a CVD method using TEOS (tetraethoxysilane: $Si(OC_2H_5)_4$) as a raw material gas. Then, the silicon oxide film 29 is planarized by a CMP (Chemical Mechanical Polishing) method or SOG (Spin On Glass) coating and etch-back to form an interlayer insulating film 29 between the first wiring pattern 28 and a second wiring pattern.

Figure 2A:
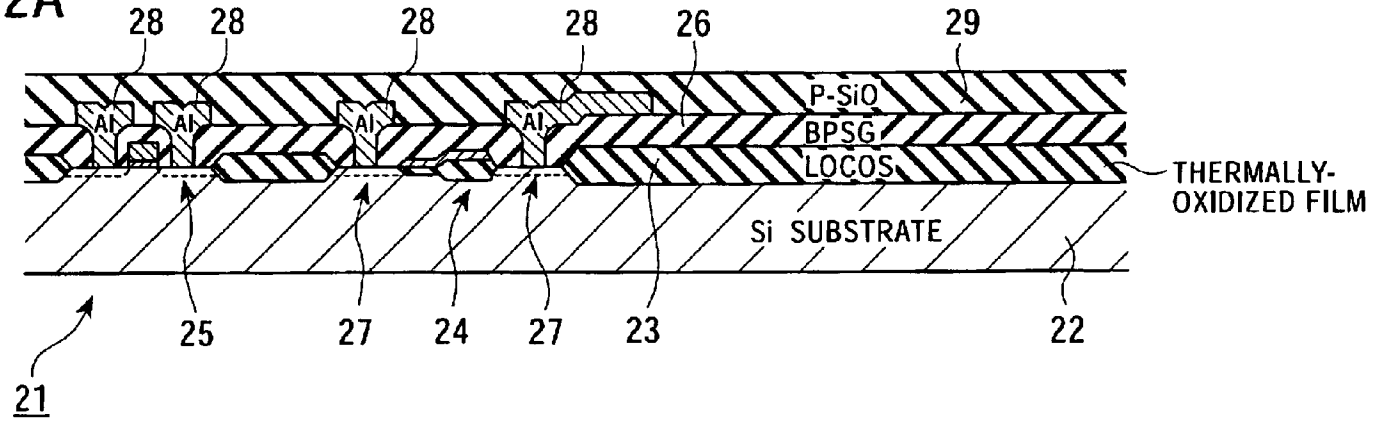
FIGS. 2A and 2B are sectional views respectively showing steps for forming the liquid discharge device shown in FIG. 1.
Figure 2B:
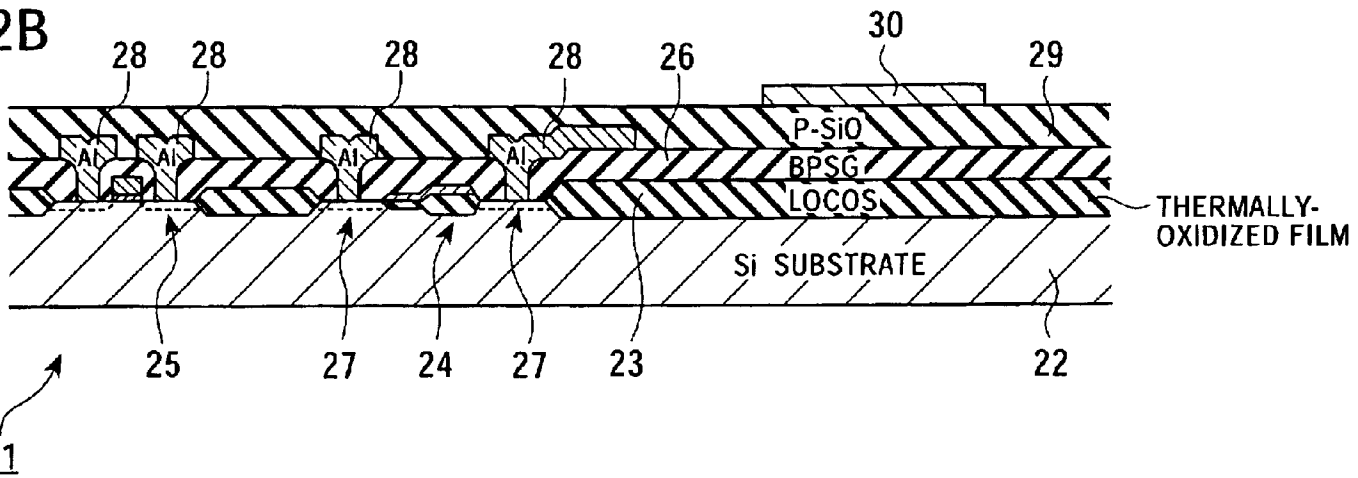

Then, as shown in FIG. 2B, a tantalum film is deposited to a thickness of 80 to 100 nm by sputtering to form a resistor film on the semiconductor substrate 22. Then, an excessive portion of the tantalum film is removed by photolithography and dry etching with $BCl_3/Cl_2$ gases to form a heating element 30 having a folded shape.

Figure 3C:
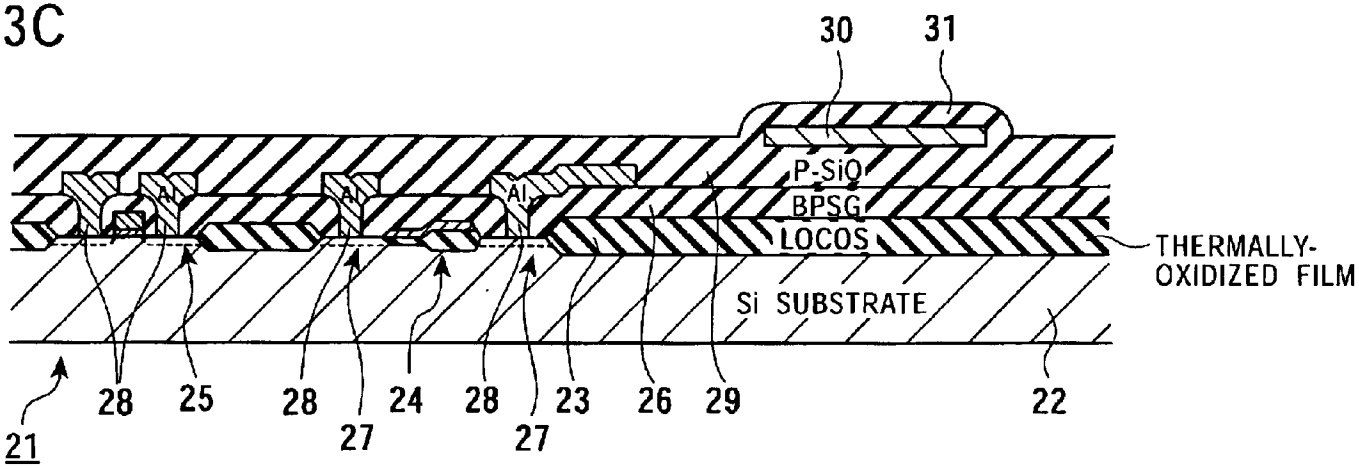
FIGS. 3C and 3D are sectional views respectively showing steps performed after the step shown in FIG. 2B.
Figure 3D:
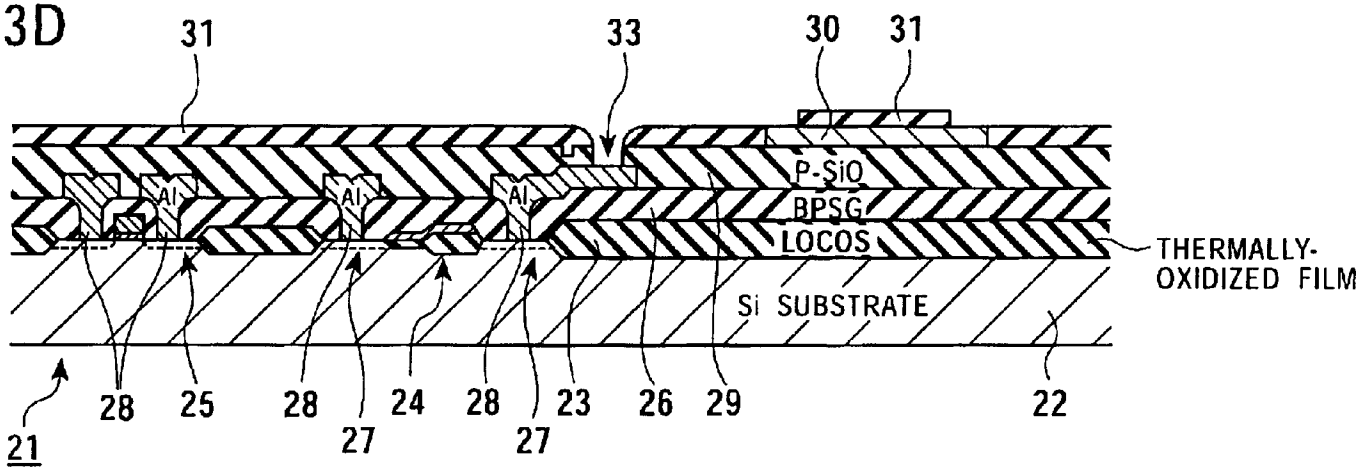

As shown in FIG. 3C, a silicon nitride film is then deposited to a thickness of 300 nm by a CVD method using a silane gas to form a protecting layer 31 for the heating element 30. As shown in FIG. 3D, the silicon nitride film is removed from predetermined portions by photolithography and dry etching with $CHF_3/CF_4/Ar$ gases to expose a portion of connection between the heating element 30 and the wiring pattern 28, and to form a via hole 33 in the interlayer insulating film 29.

Figure 4E:
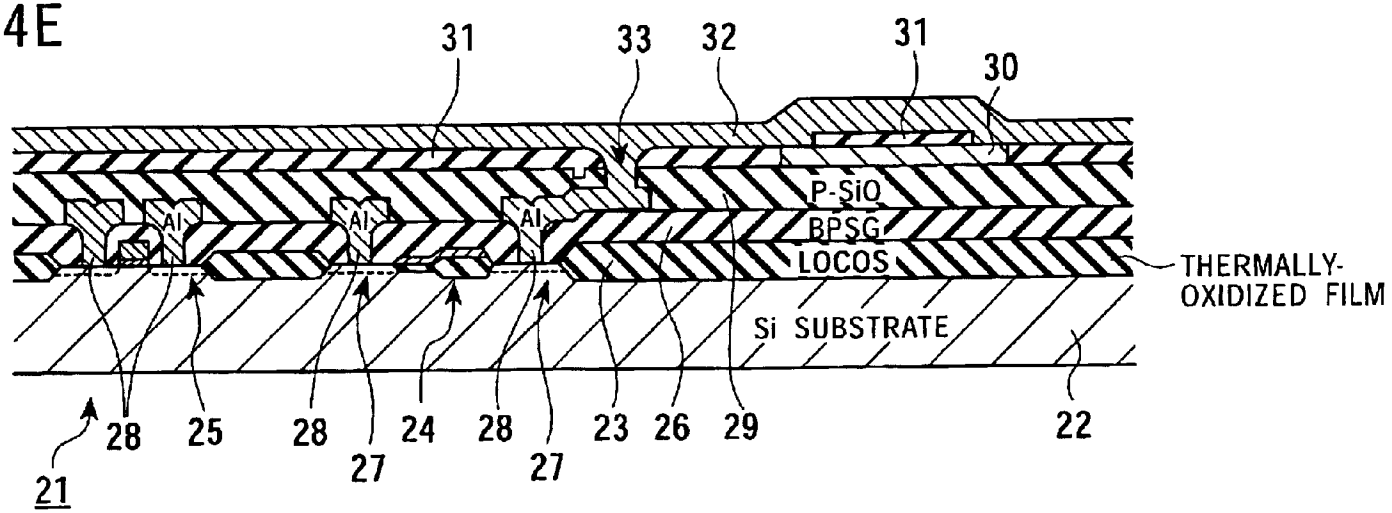
FIGS. 4E and 4F are sectional views respectively showing steps performed after the step shown in FIG. 3D.

Furthermore, as shown in FIG. 4E, aluminum containing 1 at % of silicon or 0.5 at % of copper is deposited to a thickness of 400 to 1000 nm by sputtering.

Figure 4F:
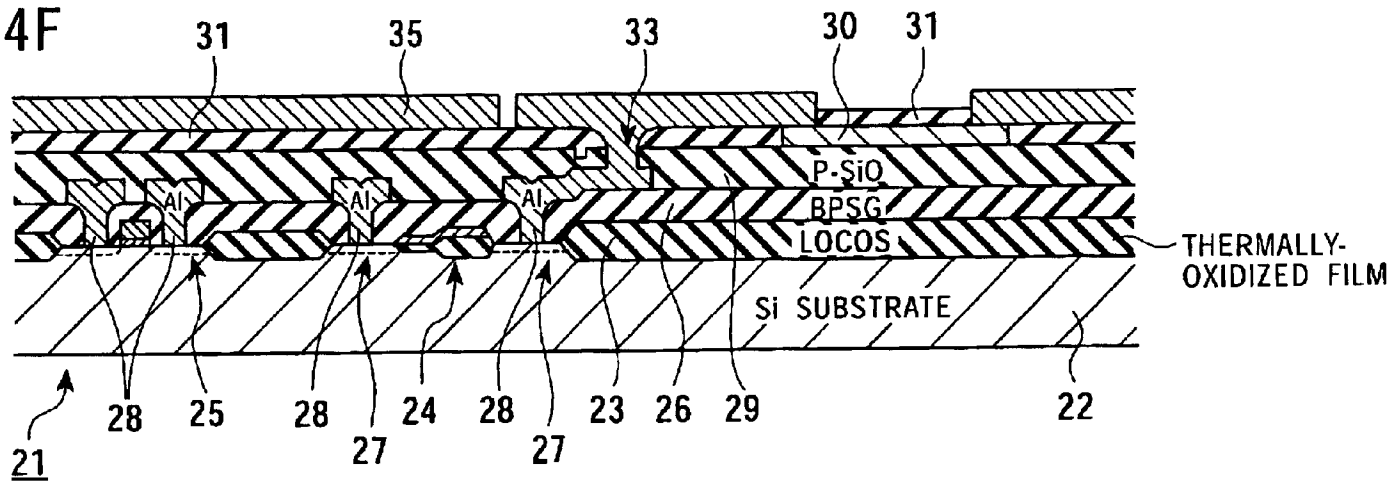

As shown in FIG. 4F, the thus-deposited wiring material 32 is then selectively removed by photolithography and dry etching with chlorine gases of $BCl_3/Cl_2$ to form a second wiring pattern 35. The second wiring pattern 35 includes a power supply wiring pattern, a grounding wiring pattern and a wiring pattern for connecting the drive transistor 24 to the heating element 30.

Figure 5G:
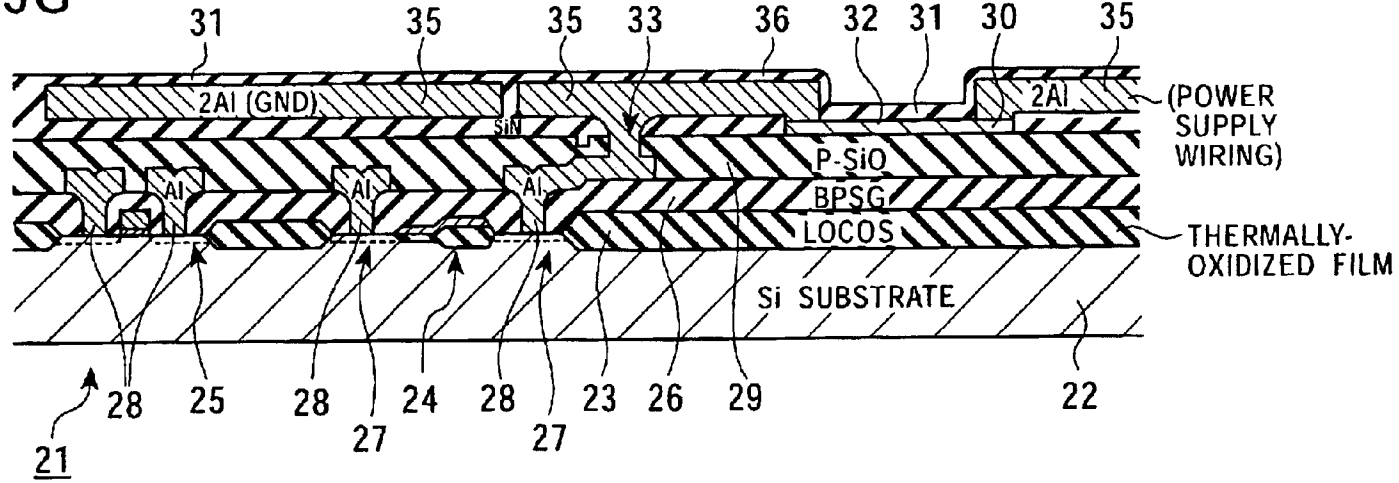
FIGS. 5G and 5H are sectional views respectively showing steps performed after the step shown in FIG. 4F.

Then, as shown in FIG. 5G, a silicon nitride film 36 ($Si_3N_4$) is deposited to a thickness of 300 to 500 nm by a CVD method to form an ink protecting layer.

Figure 5H:
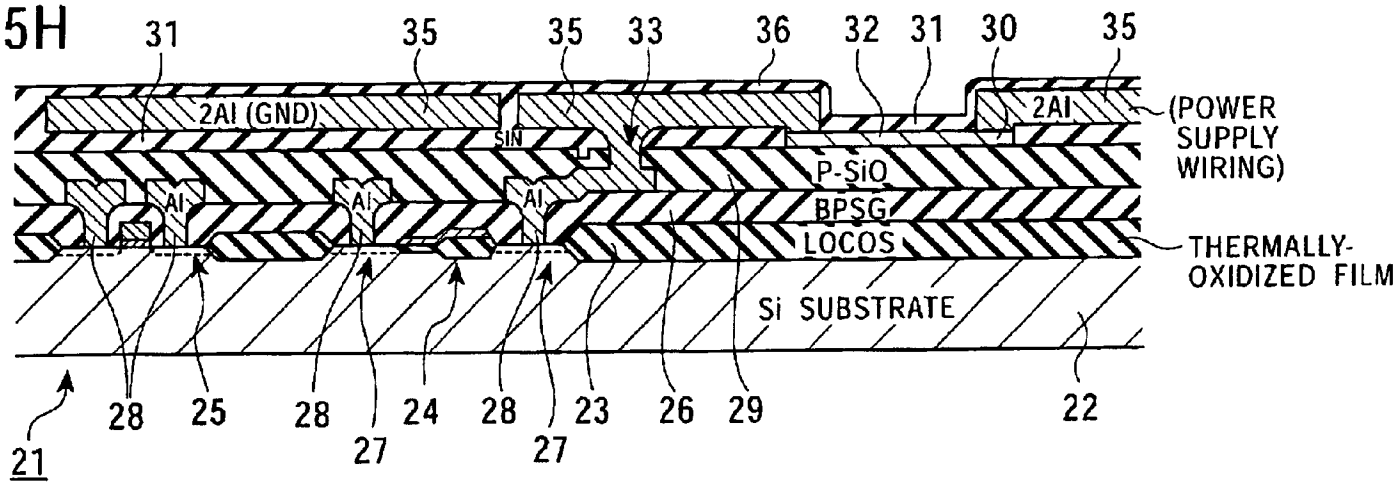

Furthermore, as shown in FIG. 5H, heat treatment is performed at 400° C. for 60 minutes in an atmosphere of a nitrogen gas containing 4% of hydrogen in a heat treatment furnace, for stabilizing the operations of the transistors 24 and 25, and stabilizing the connections between the fist and second wiring patterns 28 and 35 and between the each of the wiring patterns 28 and 35 and the transistors 24 and 25, thereby decreasing contact resistance.

Then, as shown in FIG. 1, a tantalum film is deposited to a thickness of 200 nm by sputtering to form an anti-cavitation layer 40 comprising the tantalum film. Then, a dry film 41 and an orifice plate 42 are successively laminated. The dry film 41 comprises, for example, an organic resin, and is provided by press bonding. After the dry film 41 is provided, portions corresponding to an ink chamber and an ink flow path are removed, followed by curing the dry film 41. On the other hand, the orifice plate 42 comprises a plate member formed in a predetermined shape so that a nozzle 44 is formed as a small ink discharge port above the heating element 30, and the orifice plate 42 is fixed to the dry film 41 by bonding. Therefore, the liquid discharge device 21 comprises the nozzle 44, the ink chamber 45, the flow path for introducing an ink to the ink chamber 45, etc. In this embodiment, an ink is used as a liquid to be discharged from the liquid discharge device 21. However, the liquid discharge device 21 can be applied to not only discharge of an ink, but also a device for discharging a DNA-containing solution for detecting a biological material.

(2) Operation of the Embodiment

The liquid discharge device 21 has the above-described construction comprising the element isolation regions 23 formed on the P-type silicon substrate 22 used as the semiconductor substrate, the transistors 24 and 25, which are the semiconductor elements, and the first wiring pattern 28 insulated by the insulating layer 26. Furthermore, the insulating layer 29 and the heating element 30 are formed, and then the protecting layer 31 and the second wiring pattern 35 are formed. Furthermore, the protecting layer 36 is formed, and then the connections between the wiring patterns and between the wiring patterns and the heating element are stabilized by heat treatment. Then, the anti-cavitation layer 40, the ink chamber 45 and the nozzle 44 are successively formed.

Contrary to a conventional process, in the liquid discharge device 21, the anti-cavitation layer 40 is formed. after heat treatment for sintering, and thus thermal stress due to the anti-cavitation layer 40 is not applied to the protecting layer 36 during the heat treatment, thereby preventing the occurrence of a crack.

Namely, the anti-cavitation layer 40 is required to protect the heating element by relieving cavitation, and thus a material having high stress, such as tantalum (Ta) or the like is used. The compressive stress of the tantalum film is 1.0 to $2.0\times10^{10}$ (dyne/cm$^2$), and the linear expansion coefficient of tantalum is 6.5 (ppm/degree). The linear expansion coefficient of aluminum generally used for wiring patterns is 23.6 (ppm/degree), and the linear coefficient of the protecting layer 36 comprising of $Si_3N_4$ and sandwiched between both materials is 2.5 (ppm/degree).

It is thus found that as in a conventional method, heat treatment after the anti-cavitation layer 40 is formed produces large thermal stress between these layers due to the differences between the linear expansion coefficients, and causes the concentration of the thermal stress in the protecting layer 36 to produce a crack in the protecting layer 36 due to the thermal stress.

However, in this embodiment, the anti-cavitation layer 40 is formed after heat treatment, and thus the occurrence of thermal stress due to the difference between the linear expansion coefficients of the anti-cavitation layer 40 and the protecting layer 36 can be avoided during the heat treatment. Therefore, the protecting layer 36 is subjected to only thermal stress between the protecting layer 36 and a lower layer to prevent the occurrence of a crack in the protecting layer 36, thereby effectively avoiding deterioration in reliability due to damage to the protecting layer 36.

As a result of an Al solution immersion test for measuring cracks in a liquid discharge device produced by a conventional method, cracks were observed in 20 liquid discharge device samples of 42 samples, and thus the probability of occurrence of cracks was about 48%. In the Al solution immersion test, a liquid discharge device was immersed in a mixed liquid of phosphoric acid, acetic acid and nitric acid, which was a dissolving liquid of an aluminum wiring material, to cause the dissolving liquid to enter the layer below the protecting layer 36 through a crack, so that the wiring pattern 35 was dissolved to securely visualize the crack. The conventional method of manufacturing the liquid discharge device comprises forming the anti-cavitation layer, performing heat treatment at 400° C. for 60 minutes, and then forming the protecting layer having a thickness of 300 nm.

On the other hand, as a result of the same Al solution immersion test conducted for the liquid discharge device of the this embodiment, with the protecting layer having a thickness of 300 nm, the occurrence of cracks was observed in 2 samples of 98 samples (probability of occurrence of 2%), while with the protecting layer having a thickness of 500 nm, the occurrence of cracks was not observed in 100 samples.

Figure 6:
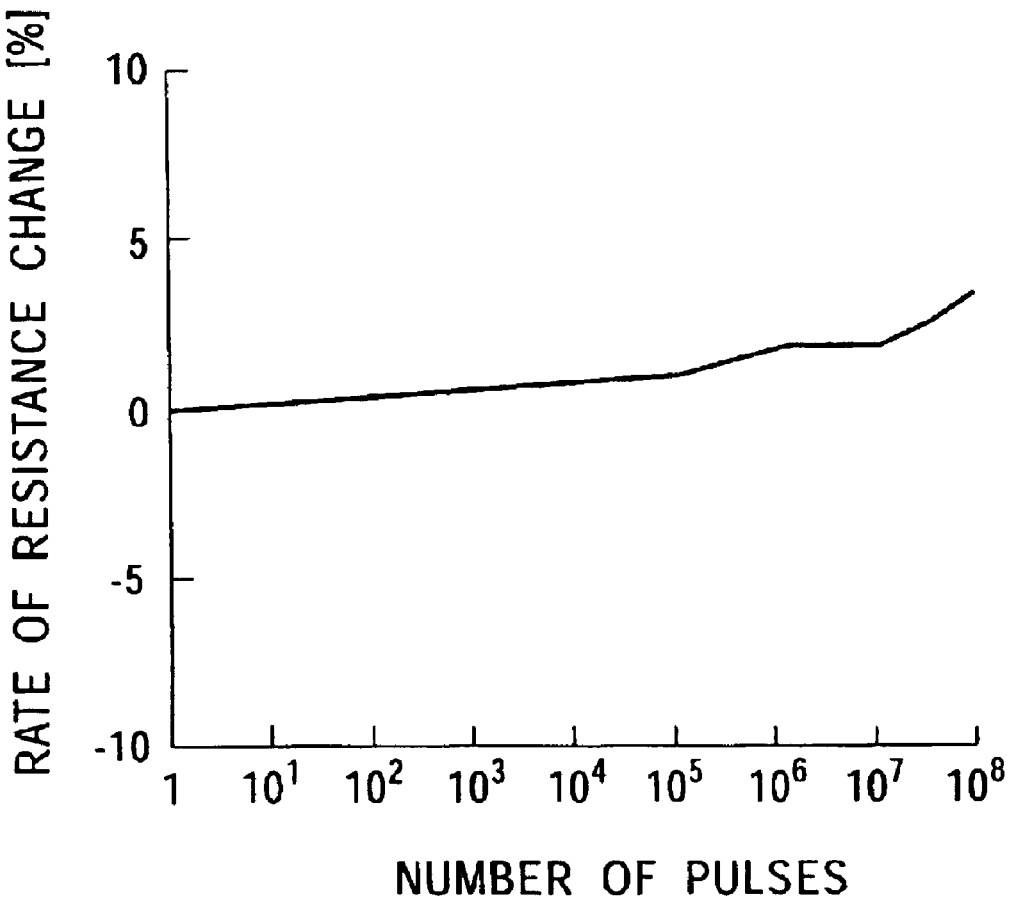
FIG. 6 is a graph of a characteristic curve showing the reliability test results of the liquid discharge device shown in FIG. 1.
Figure 7:
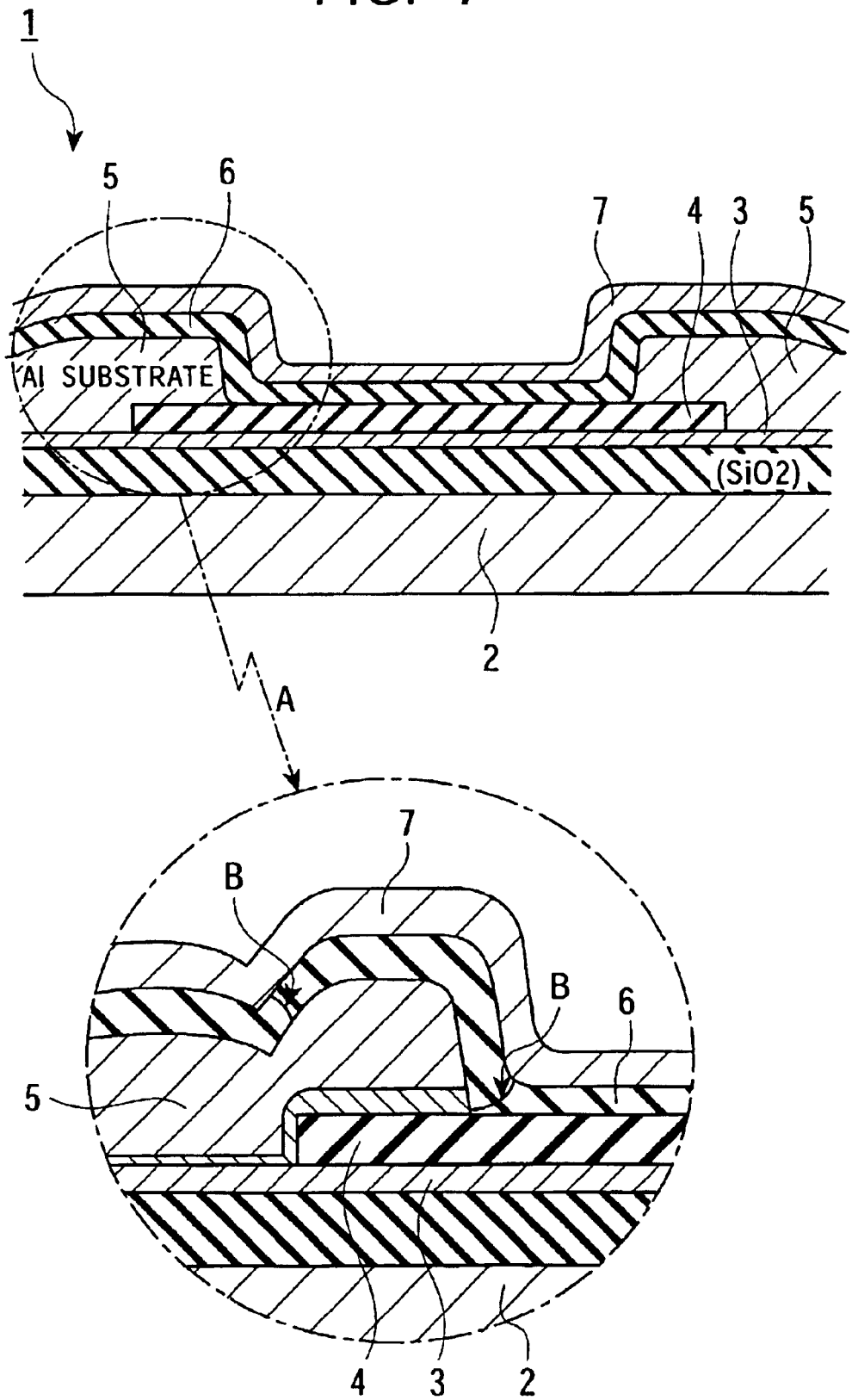
FIG. 7 is a sectional view showing a conventional liquid discharge device.
Figure 8A:
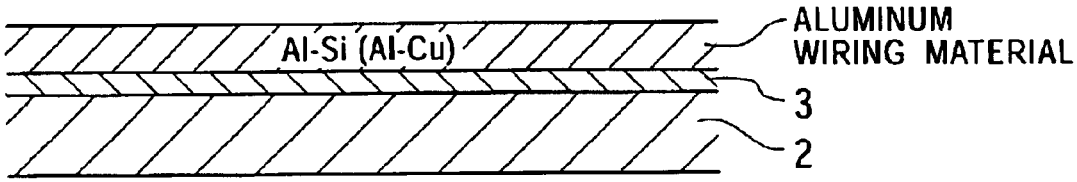
FIGS. 8A and 8B are sectional views illustrating a conventional method for preventing the occurrence of a crack.
Figure 8B:
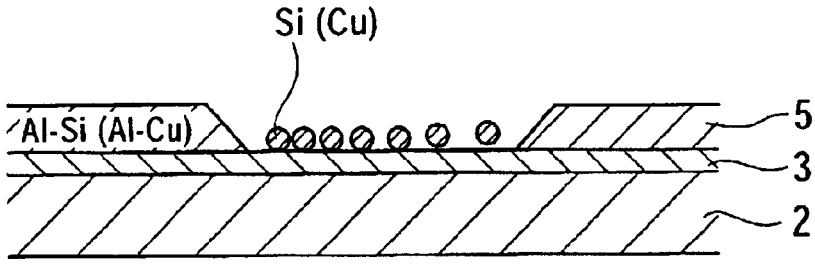

As a result of observation of changes in resistance of a heating element with repeated drives of the heating element with no ink supplied, it was found that the heating element was not disconnected, and the resistance was less changed even when a pulse was applied 100 million of times, as shown in FIG. 6. This test was conducted under a driving condition in which the heating element having a resistance of 100Ω was driven so that the power consumption per pulse was 0.85 W. The pulse was applied repeatedly, and the rate of resistance change was 4% at the time the number of the pulses was 100 million.

(3) Advantage of the Embodiment

In the above-described construction, the anti-cavitation layer is formed after heat treatment for stabilizing connection, and thus deterioration in reliability due to damage to the protecting layer can be effectively avoided.

(4) Other Embodiments

Although, in the above embodiment, the heating element is formed by using a tantalum film, the present invention is not limited to this embodiment, and various materials can be used for various laminated materials according to demand.

As described above, in the present invention, an anti-cavitation layer is formed after heat treatment for stabilizing the connection between a heating element and a wiring pattern, and thus deterioration in reliability due to damage to a protecting layer can be effectively avoided.

What is claimed is:

1. A liquid discharge device comprising:

a semiconductor element, a heating element, and a wiring pattern for connecting the semiconductor element to the heating element, all of which are formed on a semiconductor substrate, so that the heating element is driven by the semiconductor element to heat a liquid in a liquid chamber, for ejecting droplets of the liquid from a predetermined nozzle;

a protecting layer formed over the heating element, for protecting the heating element from the liquid; and an anti-cavitation layer formed for protecting the heating element from cavitation, wherein after the protecting layer is formed, at least the connections between the heating element and the wiring pattern and between the wiring pattern and the semiconductor element are stabilized by heat treatment, and then, after the heat treatment, the anti-cavitation layer is formed.

2. A method of manufacturing a liquid discharge device in which a liquid in a liquid chamber is heated to eject droplets of the liquid from a predetermined nozzle, the method comprising:

forming, on a semiconductor substrate, a semiconductor element, a heating element, and a wiring pattern for connecting the semiconductor element to the heating element so that the heating element is driven by the semiconductor element;

forming a protecting layer over the heating element to protect the heating element from the liquid;

heat-treating semiconductor substrate, for stabilizing at least the connections between the heating element and the wiring pattern and between the wiring pattern and the semiconductor element; and after performing the step of heat treatment, forming an anti-cavitation layer for protecting the heating element from cavitation.

* * * * *